US010030663B2

(12) United States Patent
Vadder et al.

(10) Patent No.: US 10,030,663 B2
(45) Date of Patent: Jul. 24, 2018

(54) METHOD AND APPARATUS FOR COOLING TOWER FAN MOUNTING FOR REMOVAL FROM INSIDE THE TOWER

(71) Applicant: Evapco, Inc., Taneytown, MD (US)

(72) Inventors: Davey J. Vadder, Manchester, MD (US); Jacob P. Myers, East Berlin, PA (US)

(73) Assignee: Evapco, Inc., Taneytown, MD (US)

( * ) Notice: Subject to any disclaimer, the term of this patent is extended or adjusted under 35 U.S.C. 154(b) by 559 days.

(21) Appl. No.: 14/484,600

(22) Filed: Sep. 12, 2014

(65) Prior Publication Data

US 2015/0240825 A1 Aug. 27, 2015

Related U.S. Application Data

(60) Provisional application No. 61/877,233, filed on Sep. 12, 2013.

(51) Int. Cl.
*F04D 25/12* (2006.01)
*F04D 29/60* (2006.01)
(Continued)

(52) U.S. Cl.
CPC ..... *F04D 25/12* (2013.01); *F04D 19/002* (2013.01); *F04D 25/08* (2013.01); *F04D 29/602* (2013.01);
(Continued)

(58) Field of Classification Search
CPC ..... F04D 19/002; F04D 25/02; F04D 25/06; F04D 25/0693; F04D 25/0686;
(Continued)

(56) References Cited

U.S. PATENT DOCUMENTS 2,573,145 A * 10/1951 Sprouse ..... F04D 29/646 417/362
2,881,688 A 4/1959 Breen
(Continued)

OTHER PUBLICATIONS

Lockout/tagout. Washington, D.C.: U.S. Dept. of Labor, Occupational Safety and Health Administration, 2002. Print.*
(Continued)

*Primary Examiner* — Devon Kramer
*Assistant Examiner* — Joseph Herrmann
(74) *Attorney, Agent, or Firm* — Whiteford, Taylor & Preston, LLP; Peter J. Davis

(57) ABSTRACT

A method and apparatus for removing and replacing an integral-motor fan from below. A support assembly has support struts fixed to a mounting ring. Mounting ring is configured to be fixed to the fan head, holding the fan in place, and support struts are configured to rest on mounting bolts fixed to a fan shroud. To mount a fan in place from below, the fan is fixed to the mounting ring of the support assembly, and the support assembly and attached fan are lifted into the fan shroud. The support assembly is rotated until the struts align with the support bolts in the fan shroud. The support assembly is then lowered until the struts come to rest on the support bolts. A power cable with a length sufficient to lower the fan support assembly out of the fan shroud prior to disconnecting the power cable from the fan body.

3 Claims, 13 Drawing Sheets

(51) Int. Cl.

| | |
|---|---|
| ***F28F 25/10*** | (2006.01) |
| ***F28C 1/00*** | (2006.01) |
| ***F04D 25/08*** | (2006.01) |
| ***F04D 29/64*** | (2006.01) |
| ***F04D 29/70*** | (2006.01) |
| ***F04D 19/00*** | (2006.01) |
| *F04D 25/06* | (2006.01) |
| *F04D 29/52* | (2006.01) |
| *F28F 9/00* | (2006.01) |

(52) U.S. Cl.
CPC ..... *F04D 29/646* (2013.01); *F04D 29/703* (2013.01); *F28C 1/00* (2013.01); *F28F 25/10* (2013.01); *F04D 25/0693* (2013.01); *F04D 29/522* (2013.01); *F05D 2240/304* (2013.01); *F05D 2250/183* (2013.01); *F28F 9/00* (2013.01); *F28F 2280/00* (2013.01); *Y10T 29/49002* (2015.01)

(58) Field of Classification Search
CPC ..... F04D 25/08; F04D 25/12; F04D 29/403; F04D 29/52; F04D 29/522; F04D 29/541; F04D 29/60; F04D 29/601; F04D 29/64; F04D 29/644; F04D 29/646; F04D 29/701; F04D 29/703; F05D 2240/304; F05D 2250/183; F24C 15/322; F25F 25/10; F28C 1/00; F28F 2280/00; Y10T 29/49002
USPC ..... 417/423.15; 126/21 R
See application file for complete search history.

(56) References Cited

U.S. PATENT DOCUMENTS

| | | | | |
|---|---|---|---|---|
| 3,165,902 | A | 1/1965 | Paugh | |
| 4,089,618 | A * | 5/1978 | Patel | F04D 29/668 416/228 |
| D249,158 | S * | 8/1978 | Morrow | F04D 29/646 D23/379 |
| 4,235,571 | A | 11/1980 | Larinoff | |
| 4,394,111 | A * | 7/1983 | Wiese | F24F 13/20 165/122 |
| 4,422,983 | A | 12/1983 | Bardo et al. | |
| 4,541,250 | A * | 9/1985 | Tropeano | B01D 53/265 62/124 |
| 4,774,911 | A | 10/1988 | Yamaguchi et al. | |
| 5,117,656 | A * | 6/1992 | Keck | F04D 29/601 417/360 |
| 5,439,618 | A | 8/1995 | Trapasso | |
| 6,133,529 | A * | 10/2000 | Gretz | F16L 37/008 16/2.1 |
| 6,638,037 | B2 * | 10/2003 | Grant | F04D 29/646 248/674 |
| 7,300,248 | B2 | 11/2007 | Wang | |
| 8,956,111 | B2 * | 2/2015 | Eddisford | F04D 29/602 248/201 |
| 9,097,261 | B2 * | 8/2015 | Haaf | F04D 29/329 |
| 2003/0210983 | A1 | 11/2003 | Yung | |
| 2009/0180877 | A1 * | 7/2009 | Lin | F04D 25/0613 416/62 |

OTHER PUBLICATIONS

International Search Report issued in corresponding International Application No. PCT/US2014/055371 dated Dec. 16, 2014.

* cited by examiner

METHOD AND APPARATUS FOR COOLING TOWER FAN MOUNTING FOR REMOVAL FROM INSIDE THE TOWER

BACKGROUND OF THE INVENTION

Field of the Invention

This invention relates to the installation and removal of cooling tower fans.

Description of the Background

Traditionally, an induced draft fan with an integral motor is mounted from the top of the fan deck. This requires that if a fan needs to be replaced in the field, the fan must be removed from atop the fan deck. FIGS. 1 and 2 show typical integral-motor induced-draft fans. FIGS. 1*a* and 1*b* show an integral-motor fan mounted on a tower. The wiring to the fan all comes from above the fan deck. There is no access to this wiring from below the fan deck. FIGS. 2*a* and 2*b* show an integral-motor fan that has not yet been installed. It can be seen from the figures that the fan mounting and wiring require that the fan be installed and removed from above.

SUMMARY OF THE INVENTION

This invention presents a method and apparatus to remove and replace horizontally-mounted fans. For simplicity, the specification will describe the invention as it applies to an induced-draft counterflow cooling tower, but any structure where an integral-motor fan is installed in a horizontal orientation may equally benefit from this invention. Cooling towers, condensers, and fluid coolers in both crossflow and counterflow configurations can use this invention. Other fan applications such as exhaust fans or dry cooling fans that are mounted horizontally could also benefit from this invention. For the purposes of describing the invention, an electrically commutated fan is described, but the invention is intended for use in connection with the removal and installation of any type of fan having an integral motor.

According to an embodiment of the invention, there is provided a fan support assembly configured to permit removal and installation of the fan from below, including a fan shroud; a plurality of support bolts fixed to said fan shroud; a support assembly comprising a center ring and a plurality of support struts; said support struts configured to align with said support bolts; and a fan comprising a fan body and fan blades, where the center ring of the support assembly is configured to be attached to said fan body.

According to another embodiment of the invention, notches are provided in the distal ends of said support struts configured to receive said support bolts.

According to another embodiment of the invention, a power cable is configured to connect with a top portion of said fan.

According to another embodiment of the invention, the system includes cable securing devices to secure a length of power cable above said fan sufficient to permit said fan and support assembly to be lowered from said fan shroud prior to disconnecting said power cable from said fan body.

According to another embodiment of the invention, a method is provided for installing a cooling tower fan into a cooling tower fan shroud having the following steps: fixing a cooling tower fan body to a fan support assembly, said fan support assembly having a plurality of support struts; attaching an end of a power cable to a top of said fan body to provide power to said fan; raising said fan and fan support assembly into a cooling tower fan shroud from below, said fan shroud having mounting bolts secured to an inside surface thereof, facing inward; aligning said support assembly brackets with said fan shroud mounting bolts; lowering said support assembly brackets onto said fan shroud mounting bolts; and attaching a length of said power cable to said fan support assembly, said length of power cable sufficient to lower the fan support assembly out of the fan shroud prior to disconnecting said power cable from said fan body.

DETAILED DESCRIPTION

Figure 1A:
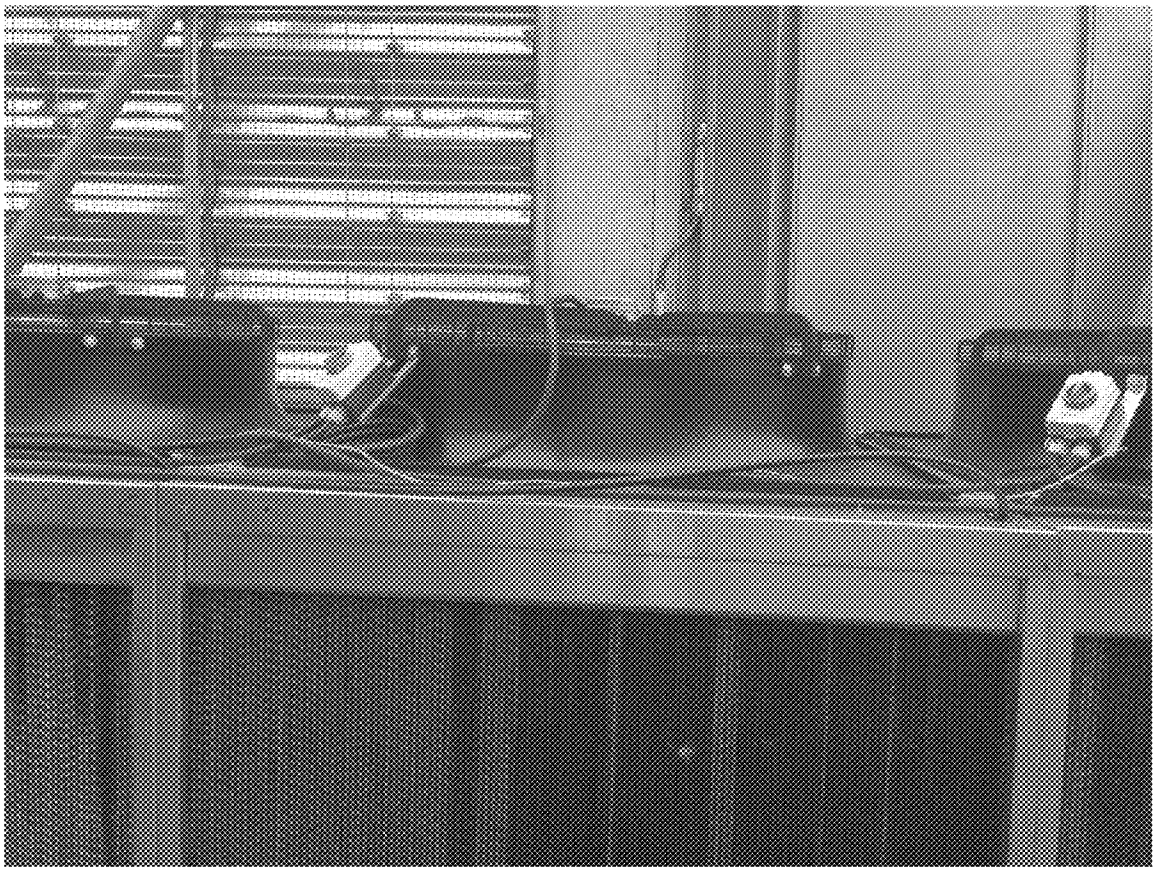
FIG. 1A PRIOR ART
FIG. 1*a* is a photograph of a prior art cooling tower fan assembly attached to the top of a cooling tower.
Figure 1B:
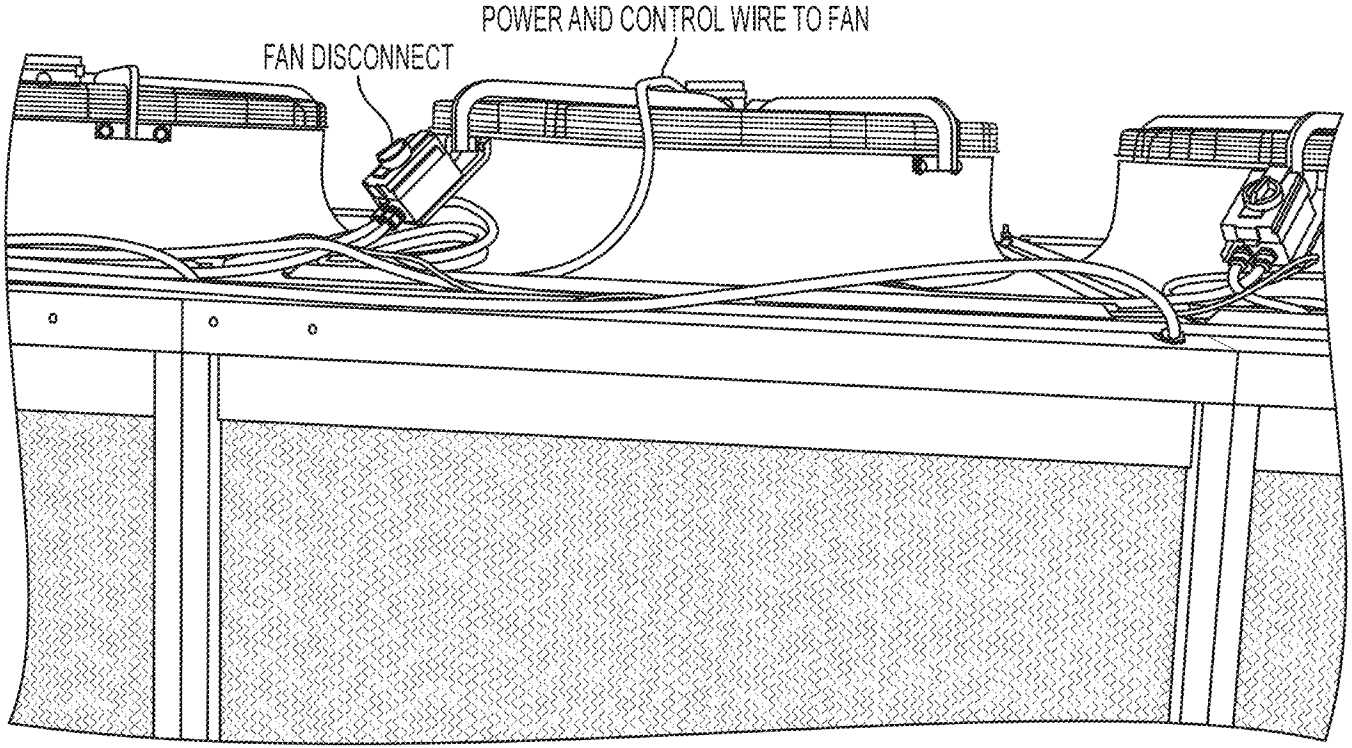
FIG. 1B PRIOR ART
FIG. 1*b* is a perspective view illustration of the prior art cooling tower fan assembly shown in FIG. 1*a*.
Figure 2A:
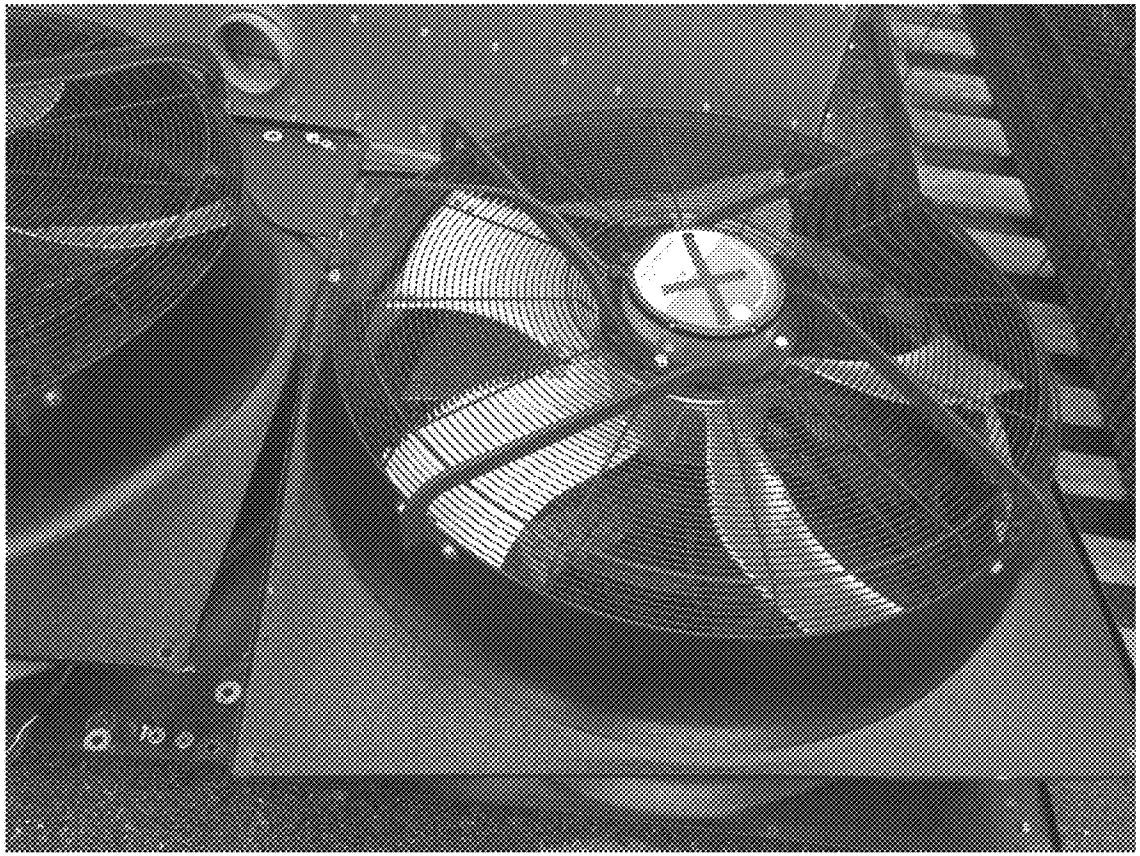
FIG. 2A PRIOR ART
FIG. 2*a* is a photograph of a perspective view of a prior art cooling tower fan assembly prior to attachment to the top of a cooling tower.
Figure 2B:
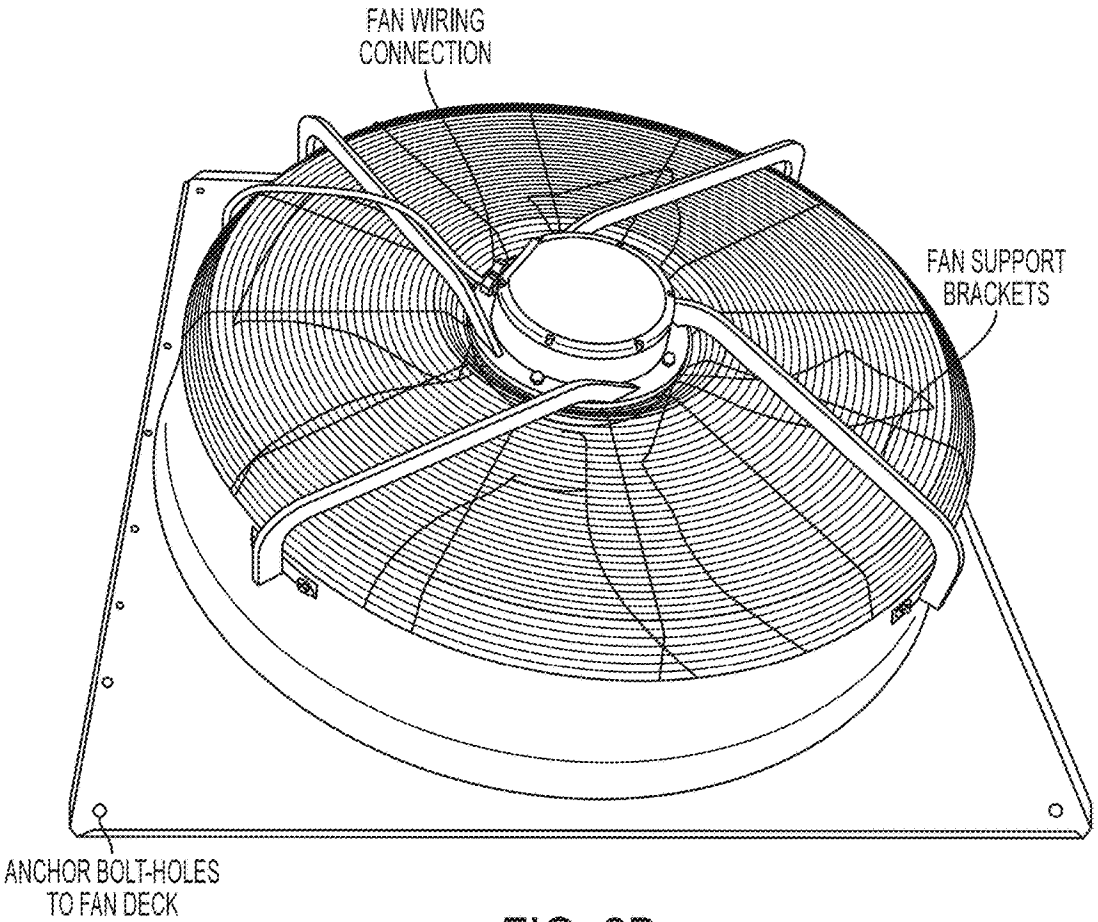
FIG. 2B PRIOR ART
FIG. 2*b* is a perspective view illustration of the prior art cooling tower fan assembly shown in FIG. 2*a*.
Figure 3:
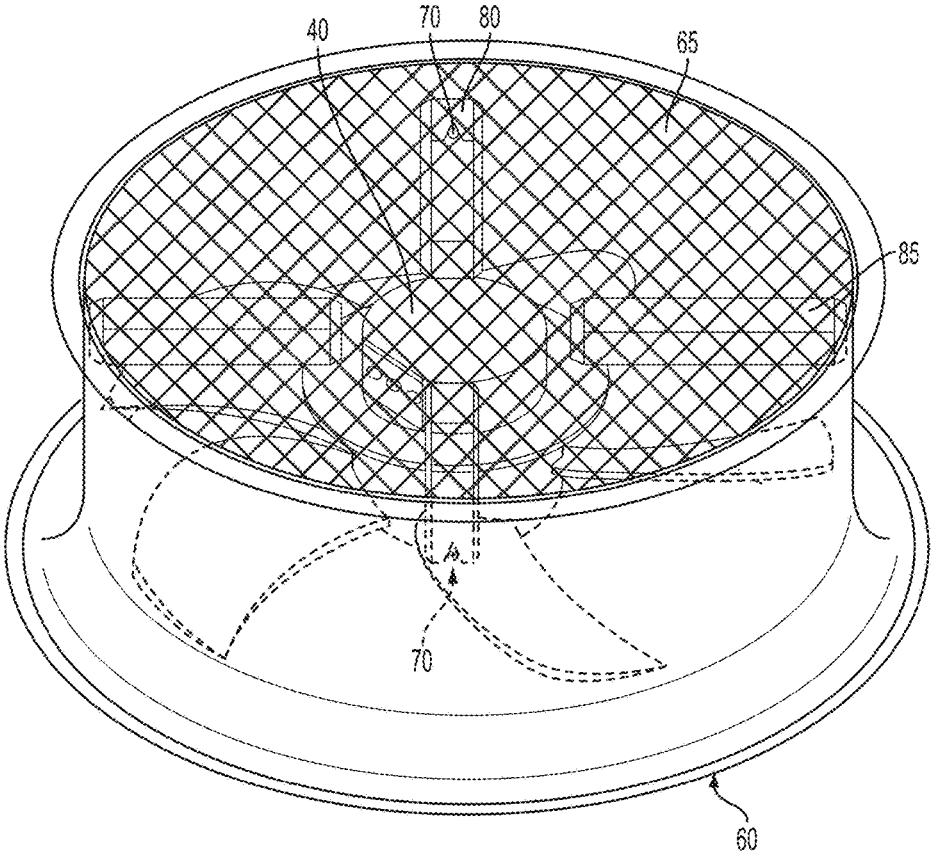
FIG. 3 is a perspective view of a cooling tower fan assembly according to an embodiment of the invention.

Referring to the figures, FIG. 3 shows a perspective view of a cooling tower fan assembly according to an embodiment of the invention, in which mounting bolts 70 that mount the fan support bracket assembly 50 to the fan shroud 60 are accessible from below and in which the fan 40 can also be disconnected electrically from below, allowing the fan 40 to be removed and replaced from below, within the interior of a cooling tower.

Figure 4:
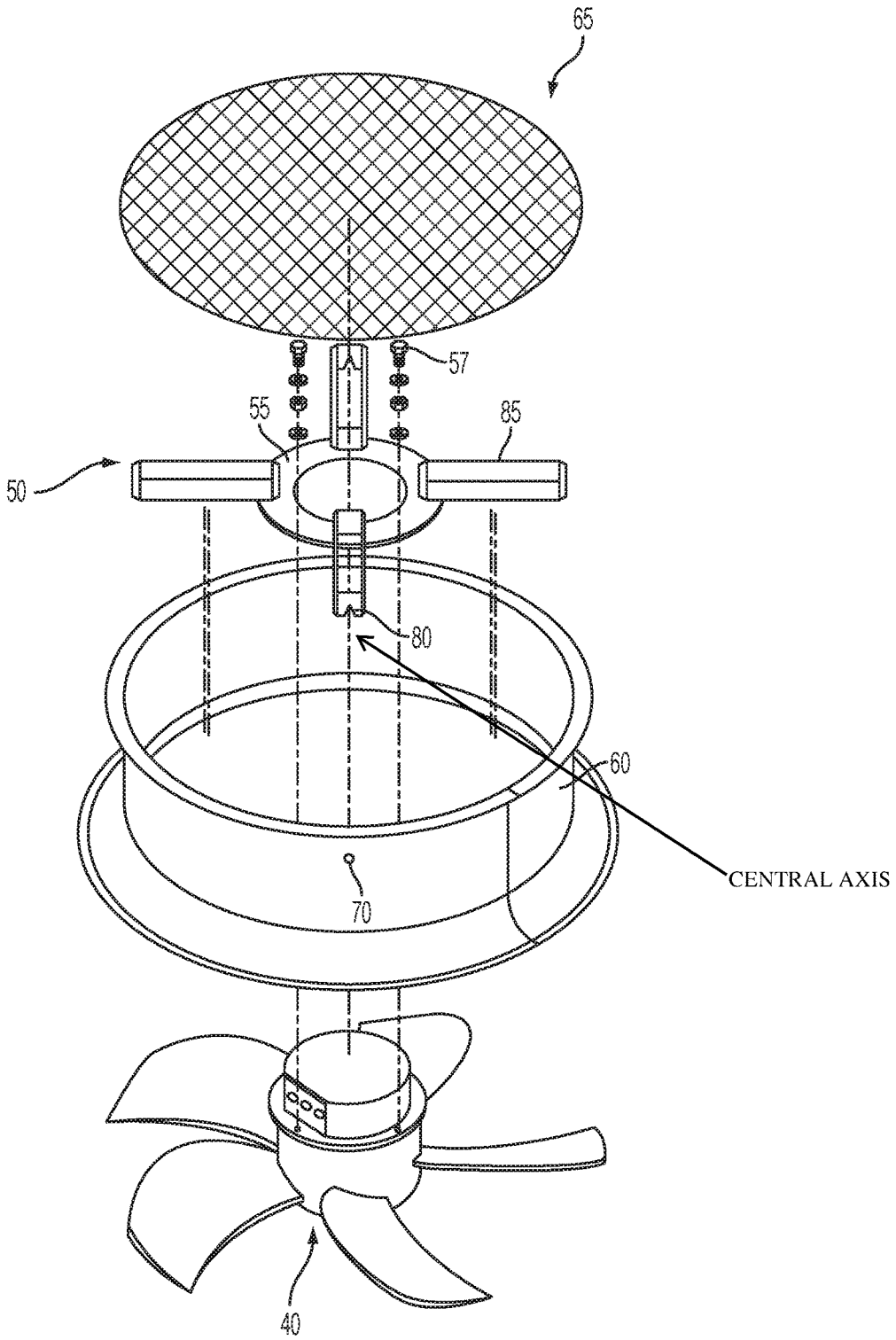
FIG. 4 shows an exploded perspective view of a cooling tower fan assembly according to an embodiment of the invention.

FIG. 4 shows an exploded perspective view of a cooling tower fan assembly according to an embodiment of the invention. Support bracket assembly 50 includes struts 85 connected and preferably welded, to ring 55. While the bracket assembly 50 shown in FIG. 4 is shown with four struts, the bracket assembly can be designed with fewer than four struts, for example only three struts, or more than four struts. Fan 40 is bolted to support bracket assembly 50 with bolts 57. Support bolts 70 are attached, and preferably welded, into the fan shroud 60. Notches 80 are made, opening downward, in the end of each strut 85 of the bracket assembly 50. Enough clearance between the top of the fan 40 and the fan screen 65 must be maintained so that the bracket assembly 50, with attached fan 40, can be lifted off of the bolts 70 without removing the fan screen 65. The support bracket assembly may be configured to maximize fan performance. Central ring 55 may be configured to act as a seal disc to prevent reverse airflow around the fan hub, and the struts 85 can act as stators straightening the airflow. Although the struts 85 shown in the illustrative embodiments are portrayed as rectangular, they can be fabricated in a curved or airfoil shape to modify and/or maximize fan performance.

Figure 5:
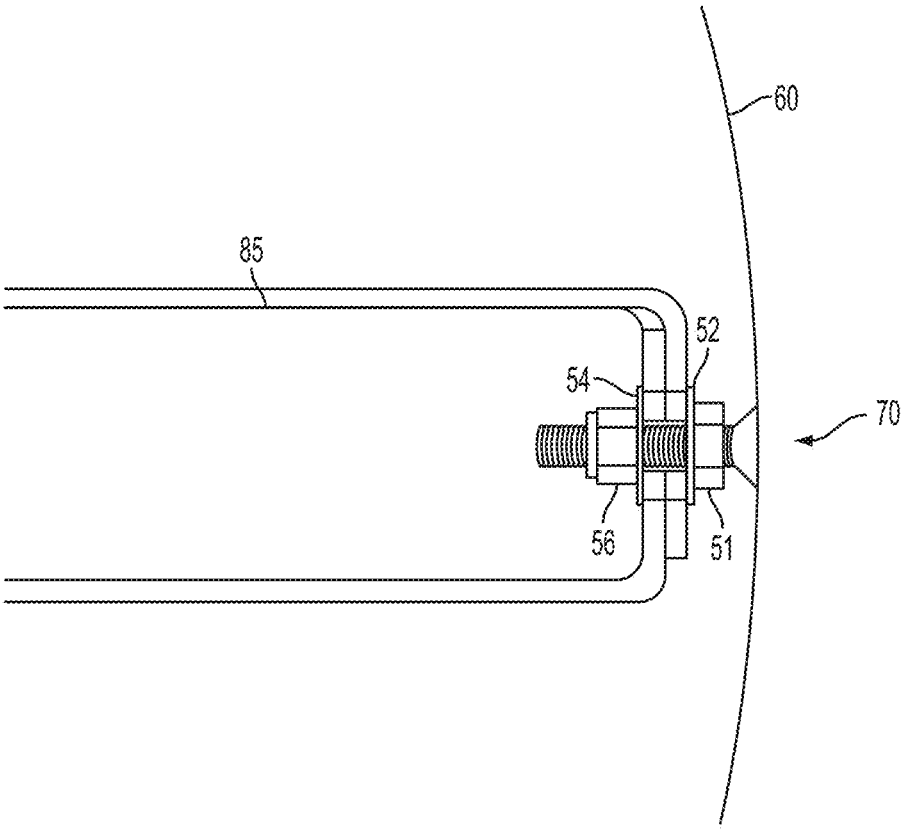
FIG. 5 shows how a cooling tower fan support strut may be connected to a fan shroud according to an embodiment of the invention.
Figure 9:
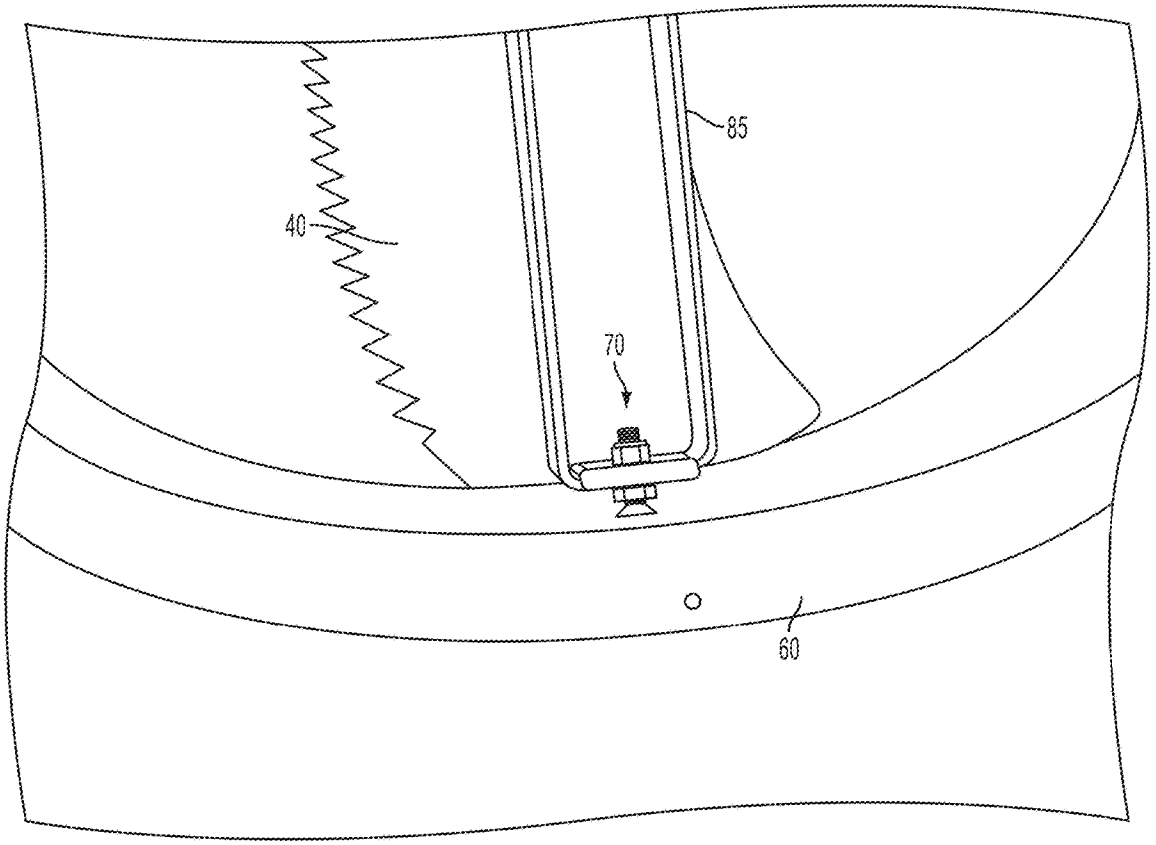
FIG. 9 is a close-up overhead perspective view of the connection between a cooling tower fan support strut and a fan shroud according to an embodiment of the invention.
Figure 10:
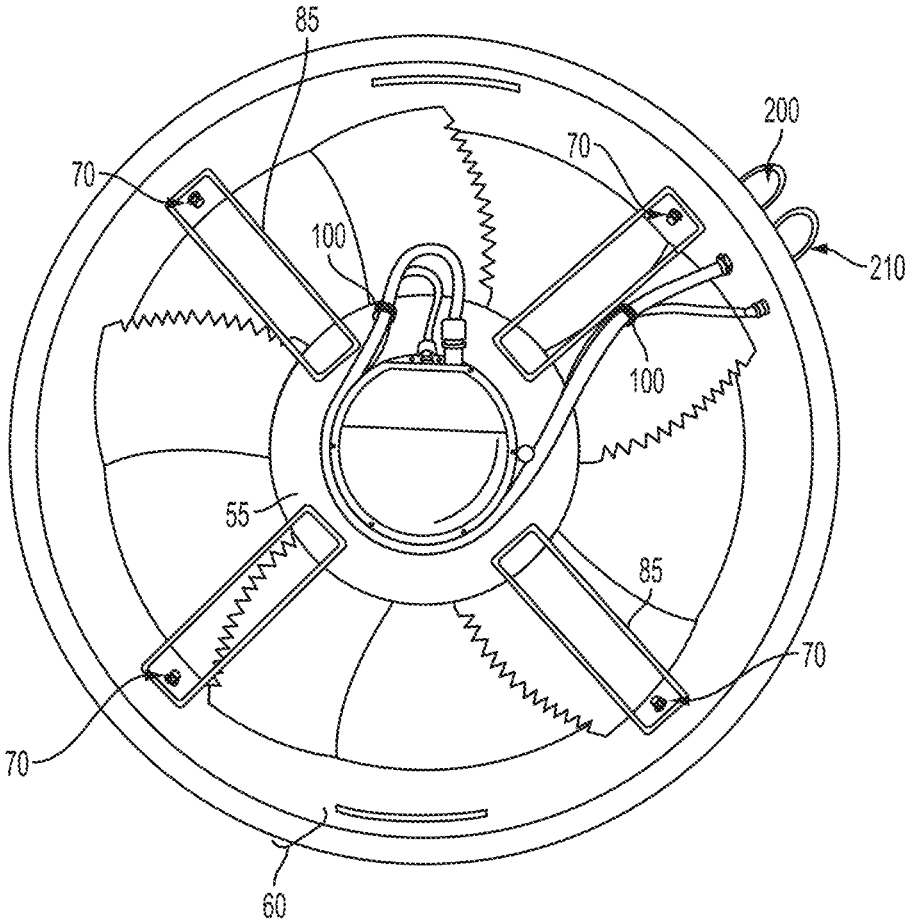
FIG. 10 is an overhead view of a cooling tower fan assembly according to an embodiment of the invention.

To mount a cooling tower fan from below using the present invention, and referring to FIG. 5, two nuts and two washers may be placed on each mounting bolt 70, the mounting bolt already having been fixed to the fan shroud 60. According to this method, a first nut 51 is run to the inside wall of the shroud 60, followed by washer 52. Fan 40 is bolted to the bracket assembly 50 using bolts 57, and the fan-bracket assembly is raised inside the fan shroud from inside the cooling tower, with the struts 85 rotated or offset relative to the location of the mounting bolts 70, and with the opening of notches 80 facing downward. Once the bottom of the struts 85 have been raised to just above to height of the mounting bolts 70, the bracket assembly is rotated so that notches 80 line up with the bolts 70. Once notches 80 are lined up with bolts 70, the bracket assembly may be lowered so that the notches 80 of the struts 85 come to rest on mounting bolts 70. Washer 54 and nut 56 are then run onto the bolt 70. Before tightening nuts 56, support bracket assembly 50 can be positioned by adjusting the outer nuts 51 on support bolts 70 until the fan 40 is centered in the fan shroud 60. Once the bracket assembly is positioned so that fan 40 is centered in the shroud, nuts 56 are tightened, locking the support bracket assembly 50, with attached fan 40, in place. FIG. 9 illustrates the bracket assembly bolted in place after the fan has been properly centered in the shroud.

Figure 6:
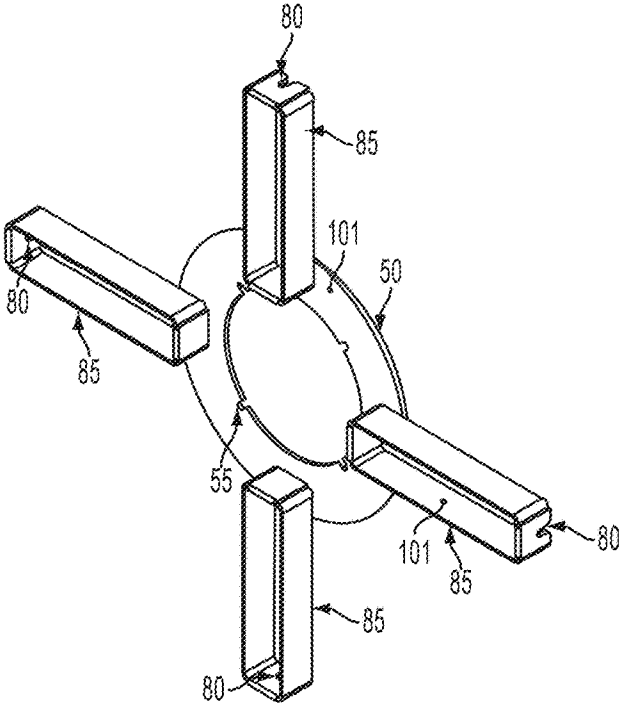
FIG. 6 is a perspective view of a cooling tower fan support assembly according to an embodiment of the invention.

Referring to FIG. 6, struts 85 are preferably welded to the top surface of ring 55 to make support bracket assembly 50, but the struts may be attached to the ring according to any known method. According to an alternate embodiment, the support bracket assembly may be an integrally molded or cast element. As discussed above, the support bracket assembly shown in the figures has four struts, but the bracket assembly may be made with three struts, or five or more according to various strength and performance requirements. FIG. 9 shows how a cooling tower fan support bracket may be connected to a fan shroud according to an embodiment of the invention.

To remove the fan, nuts 56 are loosened, the support assembly 50 with attached fan 40 is lifted off the support bolts 70, rotated enough so that the struts 85 clear the support bolts 70, and then lowered out of the fan shroud 60.

Figure 7:
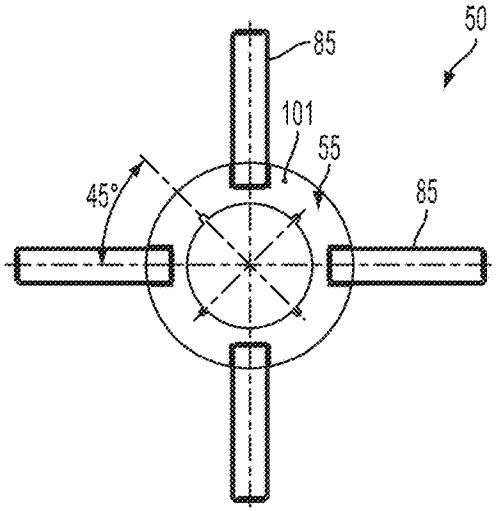
FIG. 7 is a plan view of a cooling tower fan support assembly according to an embodiment of the invention.
Figure 8:
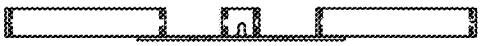
FIG. 8 is an end view of a cooling tower fan support assembly according to an embodiment of the invention.

Before removing the fan, it must be electrically disconnected. FIGS. 10 through 13 illustrate a preferred method of cabling the fan to facilitate removal of the fan from below. The electrical attachments to the fan are made in the top of the fan body. The power cable 200 and control cable 210 enter the fan shroud 60 through strain relief connectors 90. The cables are held in place on the support assembly 50 by two cable clamps 100 as they wrap around the fan. Cable clamps 100 are secured to the support assembly by removable bolts through cable clamp bolt holes 101 (see FIGS. 6 and 7). The cable clamps 100 may be removed from below by loosening the bolts that secure the clamps to the support assembly. Removing the cable clamps from the support assembly 50 allows enough slack in the cables to allow the fan 40 and support assembly 50 to be lifted off of the mounting bolts 70 and lowered below the bottom of the fan shroud 60. At that point the top of the fan housing can be disassembled and the wires detached.

Figure 11:
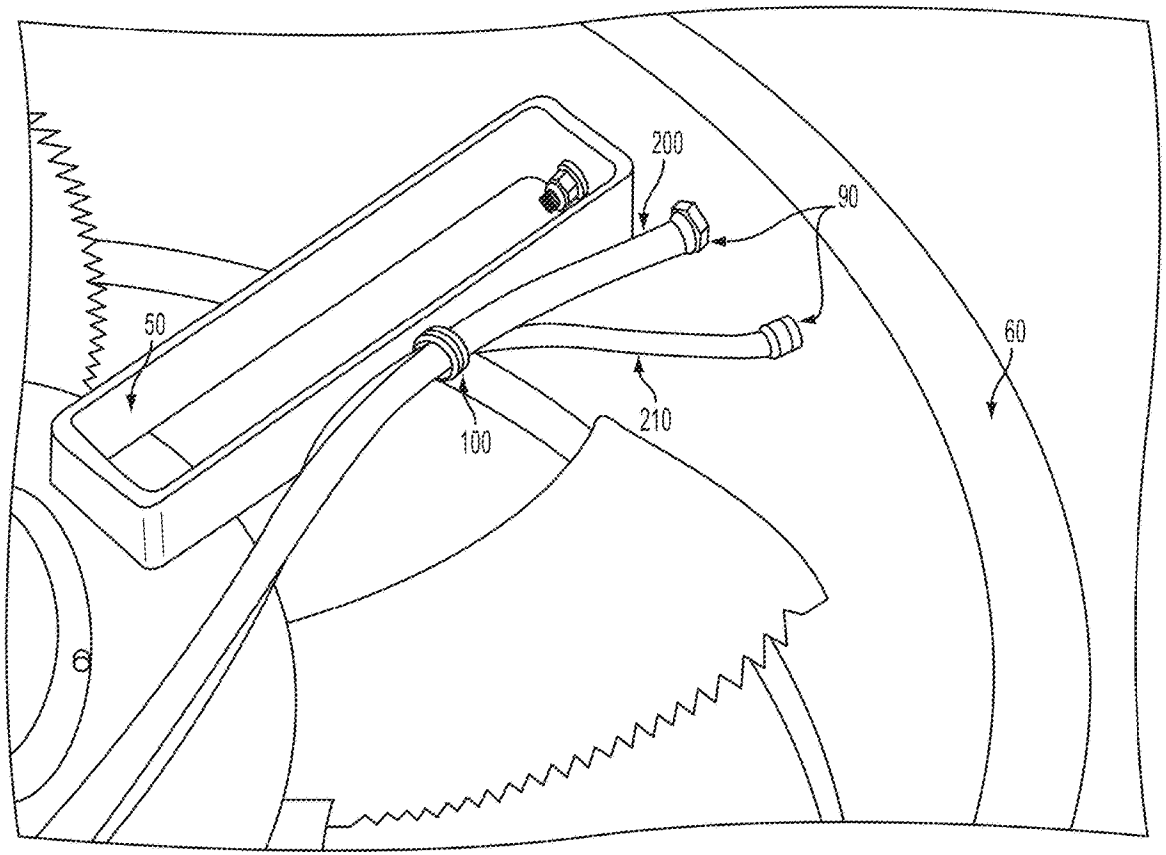
FIG. 11 is a close-up overhead perspective interior view of a cooling tower fan assembly according to an embodiment of the invention, showing the cables entering the fan cylinder through strain relief connectors.
Figure 12:
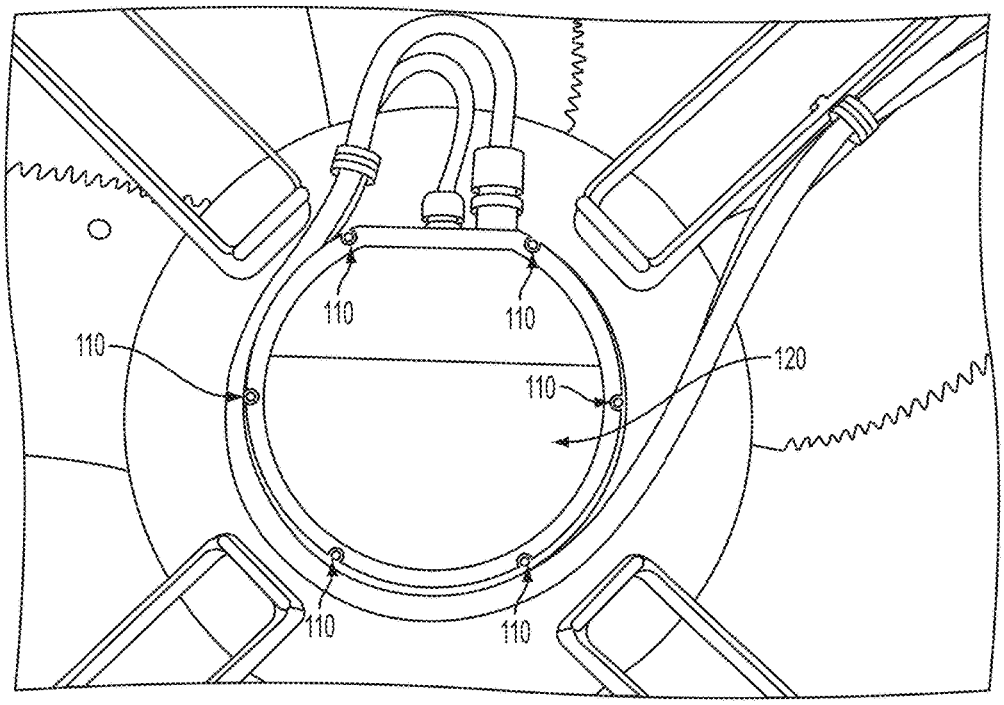
FIG. 12 is an overhead view of the fan motor and the interior most part of the fan support bracket assembly according to an embodiment of the invention, showing how the cable wraps around the fan housing.
Figure 13:
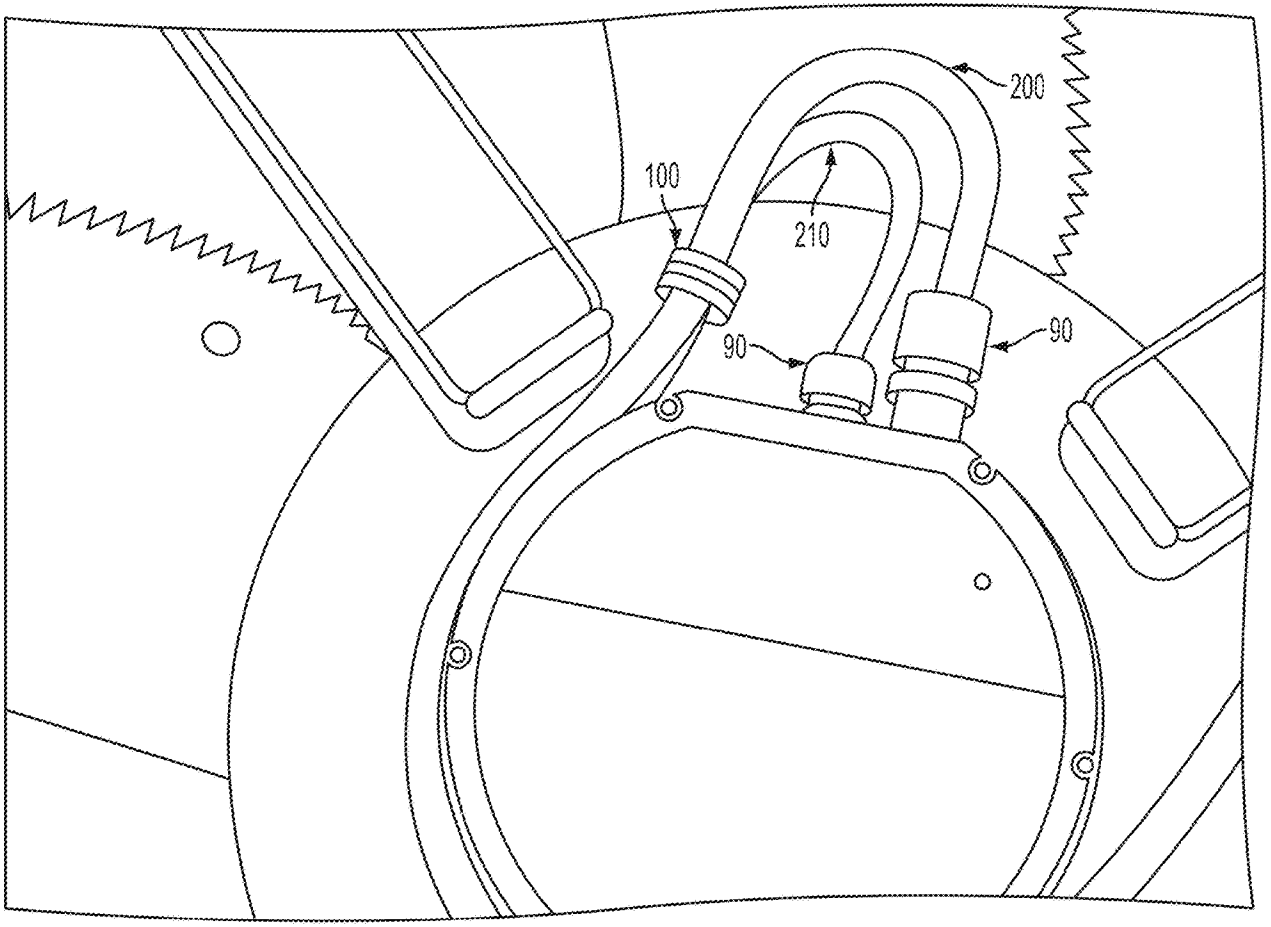
FIG. 13 is a close-up of the embodiment shown in FIG. 12 and shows how the power cable and the control cable continue through a second cable clamp and loops into two additional strain relief connectors.

FIG. 11 shows the cables entering the fan shroud 60 through strain relief connectors 90. The cables are anchored to the fan support assembly 50 with cable clamps 100. FIG. 12 illustrates how the cable wraps around the fan housing. Wrapping the cable in this manner keeps it safely away from fan blades while the fan is in operation and, when the cable clamps are released from the bracket assembly, provides enough cable length to allow the fan and support assembly to be lowered out of the fan shroud. FIG. 12 illustrates the fan housing cover bolts 110 holding the fan housing cover 120 in place. This cover must be removed in order to connect or disconnect the fan wiring. FIG. 13 illustrates how the power cable 200 and the control cable 210 continue through a second cable clamp 100 and pass through two additional strain relief connectors 90.

To remove a fan from below the following steps are preferably carried out:

Disconnect and lock-out the power;

Disconnect the two cable clamps 100 from the support assembly 50;

Loosen the nuts on all mounting bolts 70;

Lift the fan and support assembly off the mounting bolts 70, and rotate the fan and support assembly to clear the mounting bolts; and lower the fan/support assembly below the bottom of the fan shroud;

Remove the fan housing cover 120;

Disconnect wiring in fan housing;

Loosen strain reliefs 90 on fan housing and remove cables.

To reinstall a new fan from below, the same steps may be carried out in reverse.

The invention claimed is:

1. A cooling tower fan support assembly comprising:

a fan shroud comprising a cylindrical fan housing having a vertical sidewall and a central axis that is parallel to said vertical sidewall;

said vertical sidewall having an inside surface facing said central axis and an outside surface facing away from said central axis;

a plurality of support bolts attached to said vertical sidewall and portions of said support bolts extending horizontally from said inside surface of said vertical sidewall in a direction towards said central axis;

a support assembly comprising a fan attachment ring and a plurality of support struts having proximal and distal ends, said proximal ends attached to said fan attachment ring, said support struts extending horizontally away from a center point of said fan attachment ring towards said vertical sidewall of said cylindrical fan housing; and wherein said distal ends of said support struts are configured to align with and rest upon a top surface of the portions of said support bolts that extend horizontally away from said inside surface of said vertical side wall and towards said central axis;

a fan, comprising a fan body, fan motor, and fan blades, said fan attachment ring of said support assembly configured to be attached to said fan body.

2. The fan support assembly according to claim 1, further comprising a power cable configured to connect with a top portion of said fan.

3. The fan support assembly according to claim 1, further comprising cable securing devices configured to secure a length of power cable above said fan sufficient to permit said fan and support assembly to be lowered from said fan shroud prior to disconnecting said power cable from said fan body.

* * * * *